US005106162A

United States Patent [19]

Lewins et al.

[11] Patent Number: 5,106,162

[45] Date of Patent: Apr. 21, 1992

[54] METHOD OF STEERING A MINING MACHINE

[75] Inventors: Foster Lewins, Mickleover; Bruce N. Roth, Burton-on-Trent; John S. Wykes, Chellaston, all of England

[73] Assignee: Coal Industry (Patents) Limited, United Kingdom

[21] Appl. No.: 653,629

[22] Filed: Feb. 11, 1991

[30] Foreign Application Priority Data

Feb. 9, 1990 [GB] United Kingdom ..... 9002955

[51] Int. Cl.[5] ..... F21C 35/24

[52] U.S. Cl. ..... 299/10; 299/42; 299/1.05

[58] Field of Search ..... 299/1, 30, 42; 364/420

[56] References Cited

U.S. PATENT DOCUMENTS 4,228,508 10/1980 Benthaus ..... 364/505
4,643,482 2/1987 Wolfenden ..... 299/1

FOREIGN PATENT DOCUMENTS 2027548 2/1980 United Kingdom ..... 299/1
2092641 8/1982 United Kingdom ..... 299/1
2221709 2/1990 United Kingdom ..... 299/1

*Primary Examiner*—David J. Bagnell
*Attorney, Agent, or Firm*—Stevens, Davis, Miller & Mosher

[57] ABSTRACT

A method of steering a double-ended ranging drum mining machine includes the steps of positioning two previous cut roof followers spaced apart longitudinally of the machine, measuring machine tilt using a second means, estimating coal thickness using third means and generating algorithms therefrom whereby height differences between points on the current and previous cut roof can be calculated to control and steer the leading and trailing drums the algorithms being generated in such a manner that cumulative errors along or towards the face are minimized or eliminated.

21 Claims, 2 Drawing Sheets

METHOD OF STEERING A MINING MACHINE

BACKGROUND OF THE INVENTION

This invention relates to a method of steering a mining machine and particularly, although not exclusively, concerned with the steering of a double-ended ranging drum mining machine. It also has reference to the steering of a single-ended ranging drum mining machine.

Such machines are used particularly in mining minerals, such as coal, where the desired mineral is extracted from a seam by a long-wall mining method. In the long-wall mining method the machine successively traverses across a face which may be of the order of 250 m in length, cutting the mineral as it goes. In the case of a double-ended ranging drum machine, the machine carries a rotating cutting drum at each end of its ranging arms and one of the drums cuts, as a leading drum, the top of the seam while the other, the trailing drum, cuts the lower part of the seam.

It is necessary in order to maximize the economics of the mining operation to ensure that the fullest extraction of the desired mineral from the seam is taken, without there being any excursion by the cutting drums into the overlying or underlying strata. This is usually achieved by determining that a desired thickness of the mineral is left at the roof and the floor. Roof coal also helps in stabilizing roof conditions. A typical thickness is of the order of 100 mm.

One way in which this roof thickness is maintained is by measuring the amount of natural gamma radiation emitted by the adjacent strata as described in assignee's British Patent No. 1 526 028. This radiation can be picked up by a gamma detector situated on the machine and the strength of the signal received is dependent on the attenuation of the signal by the quantity of roof left after the cutting operation. If the signal is attenuated too far as the thickness increases, then a correction steering signal can be given to alter the angle of the ranging arm to alter the cut so that a lesser thickness of roof is left.

However, in order to achieve this, it is also necessary to measure physically the roof step, the difference in roof heights between the previous pass cut roof, at which a roof coal thickness measurement is available, and the leading or roof cut drum, in order that further steering of the drum can take place. Currently, this is usually done by using a roof follower which is attached to the ranging arm itself. This follower contacts the roof, cut on the previous pass, but adjacent to the drum, and physically follows its contours. As deviations occur, a transducer produces electrical signals which can be fed to a comparator for altering the angle of the ranging arm as necessary. For a double-ended ranging drum mining machine, the trailing drum must be positioned with respect to the cut roof to provide the correct extraction. Extraction control for a single-ended ranging drum mining machine is currently controlled using stored boom height. The roof cut may be made with the drum leading or trailing.

The steering may also be controlled by a factor which takes account of the inclination or tilt of the machine towards the face.

Particularly in deep seams, the roof follower, which is located in a vulnerable position close to the drum, may be a very long cantilevered arm and thus quite flexible and liable to damage, for example by mineral falling from the roof or by irregularities in the roof itself.

RELATED APPLICATIONS

In our co-pending patent application Ser. Nos. 88 19056.6 published Feb. 14, 1990 under number 2,221,709A and 88 29975.5 published Jun. 27, 1990 under number 2,226,348A we have described a method of measuring various parameters for steering respectively the leading and the trailing drum of a mineral mining machine using information taken on the previous cut. This method, which does not include vulnerably placed followers uses a transferred reference provided by the base of the machine itself to predict the height of the cut roof above an initial reference datum. However, if conditions are right, this method may lead to cumulative errors resulting in a non-optimal positioning of the machine.

SUMMARY OF THE INVENTION

It is an object of the present invention to provide an alternative method of steering which employs a less vulnerably placed roof follower and yet which avoids cumulative positional errors along the face. Through the introduction of two strategically placed previous cut roof followers, or roof height sensors, an algorithm will be developed which will reduce all steering control variables to local height differences (effectively local cut roof height differences), angles and coal thickness measurements.

According to a first aspect of the invention a method of steering a double-ended ranging drum mining machine in a seam in which the machine has at least one ranging drum located at one end of the machine arranged to cut mineral from a face to a distance at or near the interface of the mineral within an adjacent roof stratum and a trailing drum arranged to remove residual material from the face and form a floor, is characterized in that the method includes the steps of positioning two previous cut roof follower means spaced apart longitudinally of the machine and distanced from the drums, measuring machine tilt using a second means, estimating coal thickness using third means, and generating leading drum and trailing drum algorithms therefrom whereby height differences between points on the current and previous cut roof can be calculated to control and steer the leading and trailing drums, the algorithms being generated in such a manner that cumulative errors along or toward the face are minimized or eliminated.

According to a second aspect of the invention a method of steering a single-ended ranging drum mining machine in a seam in which the machine has one ranging drum located at one end of the machine arranged to cut mineral from a face to a distance at or near the interface of the mineral within an adjacent roof stratum and to remove residual material from the face and form a floor either in a single pass or in two passes along the face, is characterized in that the method includes the steps of positioning two previous cut roof follower means spaced apart longitudinally of the machine and distanced from the drum, measuring machine tilt using a second means, estimating coal thickness using third means, and generating algorithms therefrom whereby height differences between points on the current and previous cut roof can be calculated to control and steer the drum, the algorithms being generated in such a manner that cumulative errors along or toward the face are minimized or eliminated.

The height differences are calculated and may be used immediately or may be stored in memory for future use.

The roof follower means may be roof followers or roof height sensors measuring the height of the machine below the cut roof of the previous pass where one of the followers may be spaced at or about one third the distance from one end of the machine body and the other roof follower may be spaced at or about one third the distance from the other end. However, for single-ended ranging drum mining machines the spatial dispositions of the followers in relation to the drum and themselves are not required to be based on the thirds, but they may be approximately equal.

The roof follower may be mechanical and the roof height sensors may be of the non-contacting distance measuring type and may be electromagnetic, optical or ultrasonic.

The second means will include instruments for determining the tilt of the machine towards the face and/or the tilt of the machine along the face; these instruments may include inclinometers for measuring the tilt in each direction.

Preferably the third means for determining the thickness of the mineral left at the roof is a natural gamma sensing device which may be situated at or adjacent the centre of the machine body.

The leading drum algorithm in the case of a double-ended ranging drum mining machine, uses stored and present height differences between roof followers and the leading drum and between followers themselves as the basis for an estimate of the required roof step between current and previous cut roofs at the leading drum.

The trailing drum algorithm uses an alternative combination of cut roof height differences to position the trailing drum to provide the desired extraction.

The algorithm for a single ended ranging drum mining machine uses stored and present height differences between roof follower and drum and followers themselves as the basis for an estimate of the required roof step between current and previous cut roofs at the drum.

In order to assist in the understanding of the invention, the method of steering a double-ended ranging drum mining machine in accordance with the present invention will now be described below with reference to the schematic accompanying drawing and suitable algorithms deduced therefrom.

DETAILED DESCRIPTION OF THE INVENTION

Figure 1:
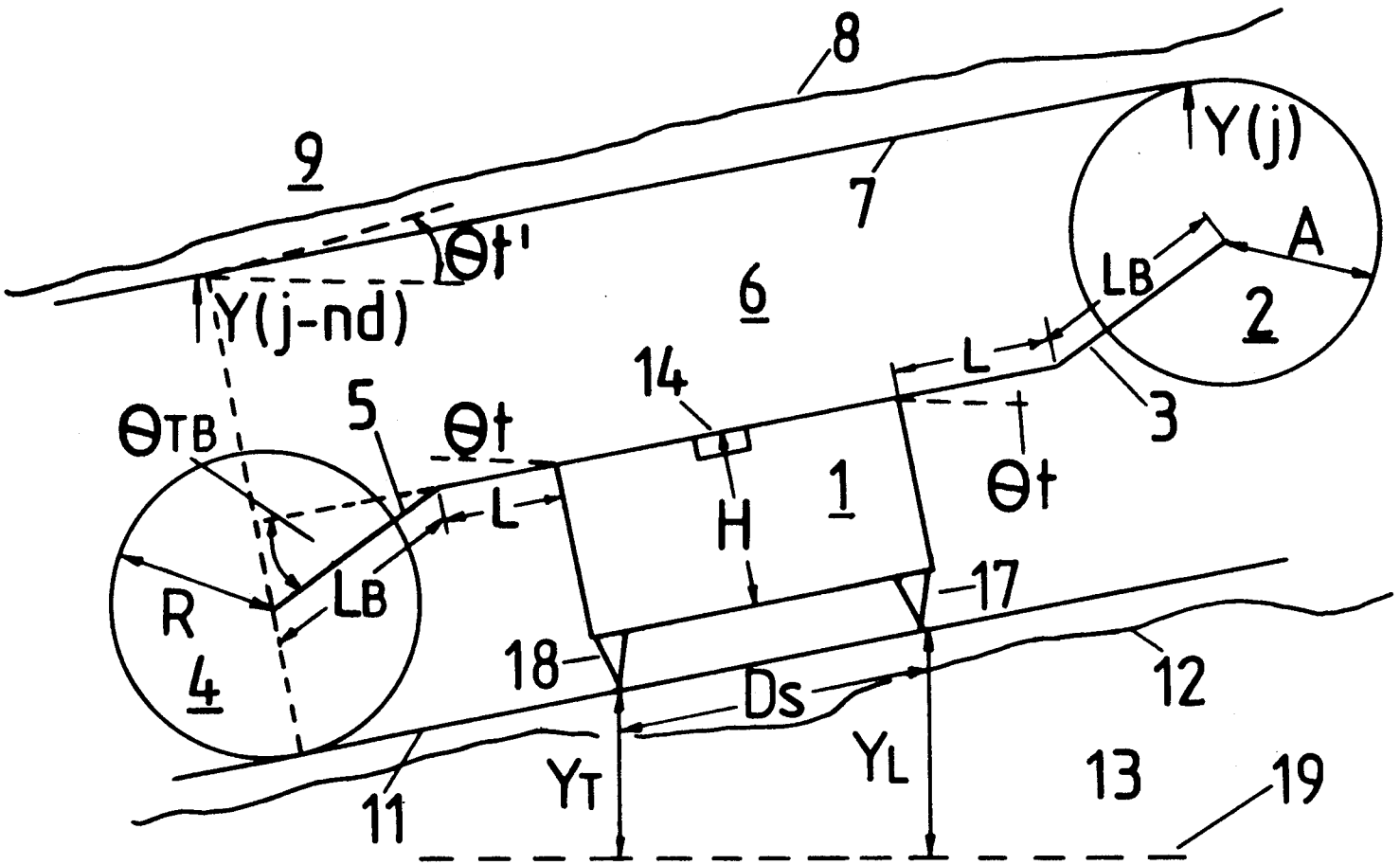
FIG. 1 is a highly diagrammatic elevational view of a double-ended ranging drum mining machine and FIG. 2 is a similar view showing the roof followers.

In FIG. 1, the body of machine is shown at 1 and it carries a leading cutting drum 2 at the end of a ranging arm 3 and a trailing cutting drum 4 at the other end of a ranging arm 5.

The drum 2 is arranged to cut in a seam 6 of a desired mineral, in this case, coal, to form a roof 7 having a thickness on average of about 100 mm at its interface 8 with the overlying stratum 9.

Figure 2:
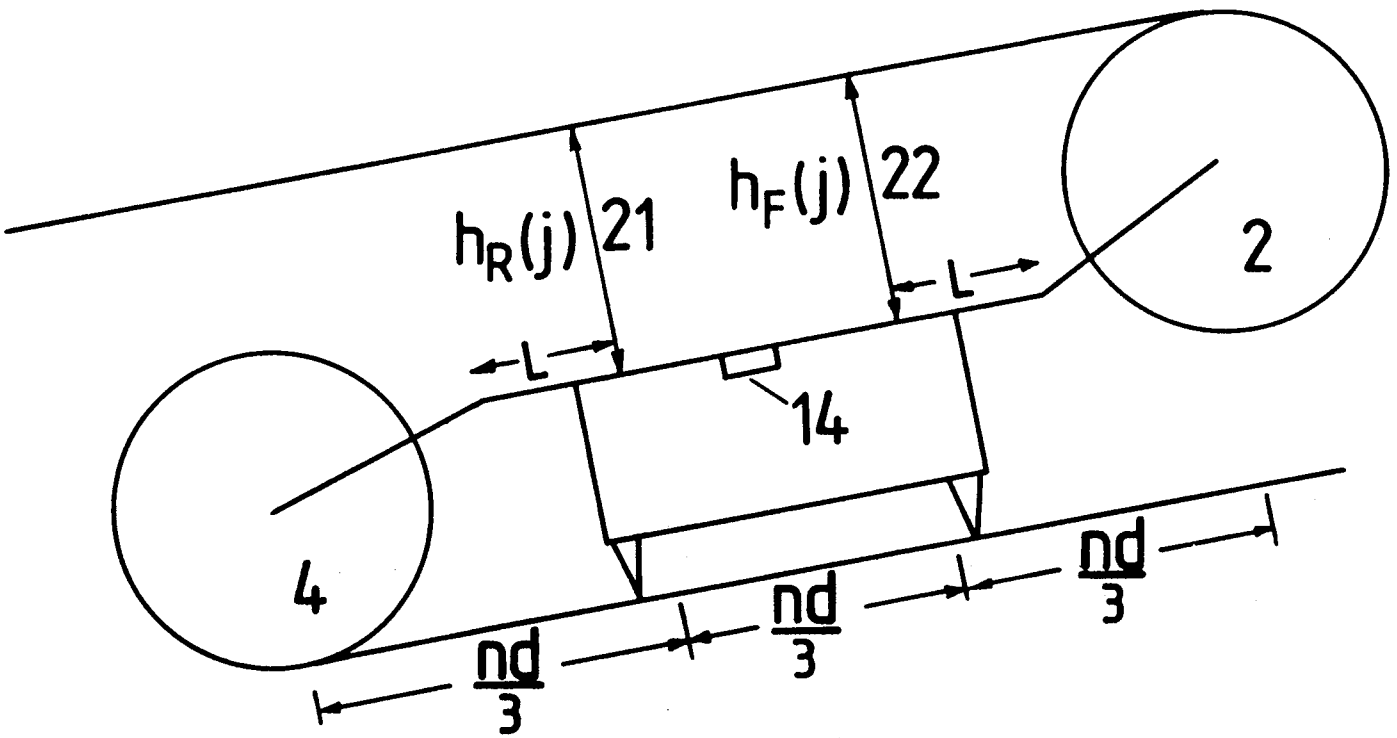

The trailing drum 4 cuts a floor 11 to leave a thin floor spaced from an interface 12 of its underlying stratum 13. The body of the machine 1 carries at 14 a natural gamma sensor substantially at the centre of the its top surface. The body of the machine 1 also has two roof followers 21 and 22 as shown in FIG. 2 to which reference is now made. The two roof followers engage the roof of the previous cut and are located a third and two thirds of the way along the length of the machine, defined here as the distance between the cutting points of the two drums. The situation is as shown in FIG. 2.

The body 1 is supported on shoes 17 and 18 which are the leading and trailing shoes respectively.

In this example, it is assumed that the face is not horizontal but is at an angle to the horizontal denoted by $\theta_t^1$. For simplicity, it is assumed that the face advance is horizontal.

There is an arbitrary reference datum line 19 established from which vertical distances are initially measured. However, it will be shown that each algorithm can be made to depend on local height differences only, so avoiding any cumulative errors.

Each drum 2 and 4 has a radius R and ranging arms 3 and 5 a length $L_B$ and pivot at a distance L from the ends of the machine 1 at a height H above the shoes. The ranging arm makes an angle $\theta_{tB}$ to the top surface of the machine 1. It is assumed that the roof height is measured at two points in the previous cut at distances nd/3 and 2nd/3 from the leading drum. The distance nd is made up of a number of increments determined by a machine movement and direction detector (MMAD intervals) and it is assumed that these increments and the distance nd will be constant and independent of other factors such as the boom angle.

The roof height at the cutting edge of the leading drum 2 is at a distance Y(j) above the datum 19, and the roof height above the trailing drum 4 is Y(j-nd).

The convention is maintained of referring to all machine data to the positional label of the leading drum when those data are obtained but roof/floor heights are given their actual positional label; thus $h_F(j)$ is the front roof height sensor reading when the leading drum is at j; it is obtained from the roof whose height is labelled $Y_p(j\text{-}nd/3)$, the p indicating that this is a previous cut roof.

The two simultaneous roof height measurements allow the difference in the previous cut roof heights to be determined directly. Thus $$\begin{aligned}\delta Y_p(j - nd/3) &= Y_p(j - nd/3) - Y_p(j - 2nd/3) \\ &= [h_f(j) - h_R(j)]\cos\theta_t(j) + nd \cdot 1/3 \sin\theta_t(j)\end{aligned} \quad (1)$$

where 1 is the length of a mmadd interval.

The height difference between the leading drum cutting the current roof at j and the previous cut roof at the forward roof sensor is $$\begin{aligned}\delta Y_{cp}(j) &= Y_c(j) - Y_p(j - nd/3) \\ &= [R - h_F(j)]\cos\theta_t(j) + \\ &\quad L\sin\theta_t(j) + L_B\sin[\theta_{LB}(j) + \theta_t(j)]\end{aligned} \quad (2)$$

where c indicates a current cut measurement. From the stored values of $\delta Y_p$ and $\delta Y_{cp}$ a roof height difference map $\delta Y_c$ can be constructed for the current cut; thus $$\begin{aligned}\delta Y_c(j) &= Y_c(j) - Y_c(j - nd/3) \\ &= Y_c(j) - Y_p(j - nd/3) + Y_p(j - nd/3) - \\ &\quad Y_p(j - 2nd/3) + Y_p(j - 2nd/3) - Y_c(j - nd/3) \\ &= \delta Y_{cp}(j) + \delta Y_p(j - nd/3) - \delta Y_{cp}(j - nd/3)\end{aligned} \tag{3}$$

The roof height difference between the current roof above the trailing drum and the previous cut roof over the rear roof follower is given by $$\begin{aligned}\delta Y_{RT} &= Y_p(j - 2nd/3) - Y_c(j - nd) \\ &= \delta Y_{cp}(j - nd/3) - \delta Y_c(j - nd/3) - \delta Y_c(j - 2nd/3) \quad (4) \\ &= \delta Y_{cp}(j - nd) - \delta Y_p(j - 2nd/3) - \delta Y_p(j - nd) \quad (5)\end{aligned}$$

The two routes around the system represented by equations (4) and (5) are in fact computationally identical since (4) is obtainable from (5) by use of (3).

The positioning of the trailing drum is done much as before; it is assumed that the desired height of the trailing drum centre is the current roof height at j-nd minus the extraction offset e(j-nd) where $$e(j\text{-}nd) = (E\text{-}R)\cdot\cos\theta_t(j\text{-}nd) \tag{6}$$

The difference between the current height of the trailing drum centre and the roof height above the rear roof follower is $$\begin{aligned}\delta Y_{TDR} &= Y_p(j - 2nd/3) - Y_{TDC}(j) \\ &= h_R(j)\cdot\cos\theta_t(j) + L_B\sin[\theta_{TB}(j) + \theta_t(j)]\end{aligned} \tag{7}$$

and for the desired extraction $$Y_{TDC}(j) = Y_c(j\text{-}nd) - e(j\text{-}nd) \tag{8}$$

Subtracting $Y_p$(j-2nd/3) from both sides of equation (8)

$$Y_{TDC}(j) - Y_p(2nd/3) = Y_c(j\text{-}nd) - Y_p(j\text{-}2nd/3) - e(j\text{-}nd)$$

i.e.

$$e(j\text{-}nd) = Y_{TDR} - Y_{RT} \tag{9}$$

is obtained.

Equation (9) is the trailing drum algorithm. Expanding (9) in terms of explicit machine variables using equations (1), (2), (5), (6) and (7) the following is obtained:

$$\begin{aligned}L_B\sin[\theta_{TB}(j) + \theta_t(j)] &= \\ &[E - h_F(j - nd)]\cos\theta_t(j - nd) + L\cdot\sin\theta_t(j - nd) + \\ &L_B\sin[\theta_{LB}(j - nd) + \theta_t(j - nd)] - \\ &[h_F(j - nd/3) - h_R(j - 2nd/3)]\cos\theta_t(j - 2nd/3) - \\ &nd\cdot 1/3\sin\theta_t(j - 2nd/3) - nd\cdot 1/3\sin\theta_t(j - nd/3) - \\ &[h_F(j - nd/3) - h_R(j - nd/3)]\cos\theta_t(j - nd/3) - \\ &h_R(j)\cos\theta_t(j) - L\cdot\sin\theta_t(j)\end{aligned} \tag{10}$$

Typically, errors in roof height measurement might be expected to be no more than several mms, while errors in tilt might be $10^{-3}$ radians. This would lead to an error estimate $$E\{\delta^2(L_B\sin[\theta_{TB}(j) + \theta_t(j)]\}^{\frac{1}{2}} = \sim\pm 10\text{ mm}$$

The leading drum algorithm is simpler than the trailing drum algorithm.

In the previous pass, information on the roof height difference between the roof above the front roof height sensor and the roof adjacent to the leading drum, is obtained from the $Y_c$ map obtained during that pass. Denoting previous pass information by the use of a "'" (prime), we have as a direct measure of the step being introduced in the roof as a result of a given boom angle setting the following expression $$\begin{aligned}\Delta(j) &= Y_c(j) - Y_c'(j) \\ &= Y_c(j) - Y_p(j - nd/3) - \\ &\quad [Y_c'(j) - Y_c'(j - nd/3)]\end{aligned} \tag{11}$$

i.e. $\Delta(j) = \delta Y_{cp}(j) - \delta Y_c'(j)$ using the fact that $$Y_p(j - nd/3) = Y_c'(j - nd/3) \tag{12}$$

Equation (11) is the leading drum algorithm expressed in a form directly compatible with the current steering method of roof step determination using the drum-axis follower.

Once again the error in Δ can be determined by expanding the roof difference quantities back into basic measurement and machine parameters. Using (1)–(3) the following is obtained:—

$$\begin{aligned}\Delta(j) = {} & [R - h_F(j)]\cos\theta_t(j) + L\sin\theta_t(j) + L_B\sin[\theta_{LB}(j) + \\ & \theta_t(j)] - [R - h_R'(j)]\cos\theta_t'(j) - L\sin\theta_t'(j) - \\ & L_B\sin[\theta_{LB}'(j) + \theta_t'(j)] - nd\cdot 1/3\cdot\sin\theta_t'(j) + \\ & [R - h_F'(j - nd/3)]\cos\theta_t'(j - nd/3) + L\sin\theta_t'(j - nd/3) + \\ & L_B\sin[\theta_{LB}'(j - nd/3) + \theta_t'(j - nd/3)]\end{aligned} \tag{13}$$

which on making the same assumptions on likely errors and typical machine dimensions leads to $$E\{\delta^2(\Delta(j))\}^{\frac{1}{2}} = \sim\pm 8\text{ mm}$$

It should be noted that errors in mmadd interval, along the face machine, positionings have been ignored. However, in leading drum algorithms where two strips are involved it may well be that they are more severe and in particular the validity of equation (12) would need to be examined.

For the purposes of comparison it may well be sensible to add a coal thickness error to that of the roof step yielding finally an error for the leading drum of approximately ±13 mm.

We claim:

1. A method of steering a double-ended ranging drum mining machine in a seam in which the machine has at least one ranging drum located at one end of the machine arranged to cut mineral from a face to a distance at or near the interface of the mineral within an adjacent roof stratum and a trailing drum arranged to remove residual material from the face and form a floor, characterized in that the method includes the steps of positioning two previous cut roof follower means spaced apart longitudinally of the machine and distanced from the drums, measuring machine tilt using a second means, estimating coal thickness using third means, and generating leading drum and trailing drum algorithms therefrom whereby height differences between points on the current and previous cut roof can be calculated to control and steer the leading and trailing drums, algorithms being generated in such a manner that cumulative errors along or toward the face are minimized or eliminated.

2. A method according to claim 1 in which the height differences are calculated and used immediately or are stored in memory for future use.

3. A method according to claim 1 in which the leading drum algorithm uses stored and present height differences between roof followers and the leading drum and between followers themselves as the basis for an estimate of the required roof step between current and previous cut roofs at the leading drum.

4. A method according to claim 1 in which the trailing drum algorithm uses an alternative combination of cut roof height differences to position the trailing drum to provide the desired extraction.

5. A method according to claim 1 in which the roof follower means are roof followers adapted to measure the height of the machine below the cut roof of the previous pass where one of the followers is spaced at or about one third of the distance from one end of the machine body and the other roof follower is spaced at or about one third of the distance from the other end.

6. A method according to claim 1 in which the roof follower means are roof height sensors adapted to measure the height of the machine below the cut roof of the previous pass where one of the followers is spaced at or about one third of the distance from one end of the machine body and the other roof follower is spaced at or about one third of the distance from the other end.

7. A method according to claim 1 in which the second means includes measuring means for determining the tilt of the machine towards the face and along the face.

8. A method according to claim 7 in which the measuring means includes inclinometers for measuring the tilt in each direction.

9. A method according to claim 1 in which the second means includes measuring means for determining the tilt of the machine towards the face.

10. A method according to claim 1 in which the second means includes measuring means for determining the tilt of the machine along the face.

11. A method according to claim 1 in which the third means for determining the thickness of the mineral left at the roof is a natural gamma sensing device situated at or adjacent the centre of the machine body.

12. A method of steering a single-ended ranging drum mining machine in a seam in which the machine has one ranging drum located at one end of the machine arranged to cut mineral from a face to a distance at or near the interface of the mineral within adjacent roof stratum and to remove residual material from the face and form a floor either in a single pass or in two passes along the face, the method including the steps of positioning two previous cut roof follower means spaced apart longitudinally of the machine and distanced from the drum, measuring machine tilt using a second means, estimating coal thickness using third means, and generating algorithms therefrom whereby height differences between points on the current and previous cut roof can be calculated to control and steer the drum, the algorithms being generated in such a manner that cumulative errors along or toward the face are minimized or eliminated.

13. A method according to claim 12 in which the spatial dispositions of the followers in relation to the drum and the followers are approximately equal.

14. A method according to claim 12 in which the height differences are calculated and used immediately or are stored in memory for future use.

15. A method according to claim 12 in which the roof follower means are roof followers adapted to measure the height of the machine below the cut roof of the previous pass where one of the followers is spaced at or about one third of the distance from one end of the machine body and the other roof follower is spaced at or about one third of the distance from the other end.

16. A method according to claim 12 in which the roof follower means are roof height sensors adapted to measure the height of the machine below the cut roof of the previous pass where one of the followers is spaced at or about one third of the distance from one end of the machine body and the other roof follower is spaced at or about one third of the distance from the other end.

17. A method according to claim 12 in which the second means includes measuring means for determining the tilt of the machine towards the face and along the face.

18. A method according to claim 17 in which the measuring means includes inclinometers for measuring the tilt in each direction.

19. A method according to claim 12 in which the second means includes measuring means for determining the tilt of the machine towards the face.

20. A method according to claim 12 in which the second means includes measuring means for determining the tilt of the machine along the face.

21. A method according to claim 12 in which the third means for determining the thickness of the mineral left at the roof is a natural gamma sensing device situated at or adjacent the centre of the machine body.

* * * * *